US005699562A

United States Patent [19]

Lu

[11] Patent Number: 5,699,562

[45] Date of Patent: Dec. 23, 1997

[54] DETERGENT CONTROLLING MEANS FOR USE IN A TOILET

[76] Inventor: Nien-feng Lu, No. 38, Chinghua St., Taipei, Taiwan

[21] Appl. No.: 759,938

[22] Filed: Dec. 3, 1996

[51] Int. Cl.[6] ..... E03D 9/02

[52] U.S. Cl. ..... 4/223; 4/222; 222/133

[58] Field of Search ..... 4/223, 224, 222, 4/225.1, 226.1, 227.1; 222/133, 129.2

[56] References Cited

U.S. PATENT DOCUMENTS

| | | | |
|---|---|---|---|
| 3,911,507 | 10/1975 | Johnson | 4/224 |
| 4,738,833 | 4/1988 | Gray | 4/223 |
| 5,042,095 | 8/1991 | Schoepe et al. | 4/225.1 |
| 5,603,126 | 2/1997 | Scoggins | 4/223 |

*Primary Examiner*—David J. Walczak

*Attorney, Agent, or Firm*—Kirkpatrick & Lockhart LLP

[57] ABSTRACT

A detergent controlling mechanism for use in a toilet is configured to have a container having a first entrance defined through an outer periphery thereof, an adjusting apparatus having a third rod threadingly connected with the outer periphery of the container, a partition which securely and sealingly separates the container into an upper portion and a lower portion, a leverage having a fulcrum pivotally connected to a bridge and securely mounted onto the partition, an inlet valve having a first rod abutting a first end of the bridge and slidably received within a chamber of a second seat, a one-way valve for directing flow only from the first part to the second part and which is sealingly mounted on a board which separates the lower portion into a first part and a second part and a releasing valve mounted onto the partition for determining an amount of detergent to be released. The controlling mechanism is thus able to release a fixed amount of detergent to a water tank every time a user flushes the toilet.

3 Claims, 4 Drawing Sheets

DETERGENT CONTROLLING MEANS FOR USE IN A TOILET

1. Field of the Invention

The present invention generally relates to a detergent controlling means for use in a toilet, and more particularly to a controlling means which is able to release a fixed amount of detergent to flush water in a toilet bowl.

2. Background of the Invention

The convenience of a toilet is that it is able to flush away human waste by the water stored in a water tank. Yet, as the frequency of using the toilet increases, an inner surface of the toilet bowl may be contaminated. To avoid the contamination of the inner surface of the toilet bowl, a solid state cleaning solute is introduced to the market. When in use, the cleaning solute is put into the water tank and is thus gradually dissolved in the water which is stored in the water tank. Therefore, every time a user flushes the toilet, clean water mixed with the dissolved solid state cleaning solute will then flow out through a pipe and thus clean the outer surface of the toilet. The solid state cleaning solute does have an effect of cleaning, yet, it still suffers a disadvantage which is that when a time interval of flushing the toilet increases, a concentration of the solution of the cleaning solute will be stronger, and when the time interval of flushing the toilet decreases, the concentration of the solution of the cleaning solute will then be lighter. Thus, the cleaning solute clearly can not solve the difference of having different concentrations when the time interval of flushing the toilet varies.

From the previous description, it is noted that many kinds of products sold in the market can not fulfill the requirements of cleaning the inner surface of the toilet bowl and maintaining the same concentration in the same time.

Thus, a detergent controlling means for use in a toilet and constructed in accordance with the present invention tends to mitigate and/or obviate the aforementioned problems.

SUMMARY OF THE INVENTION

The main objective of the invention is to provide a detergent controlling means for use in a toilet. The detergent controlling means is able to release a fixed amount of liquid detergent which then flows through a pipe to be mixed with the clean water in a water tank.

Another objective of the invention is to provide a detergent controlling means which is totally controlled by a pressure difference between an inlet and an outlet and no extra power is needed to maintain the operation of the means.

Still another objective of the invention is to provide an adjusting apparatus which is able to adjust the amount of detergent released by the controlling means.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
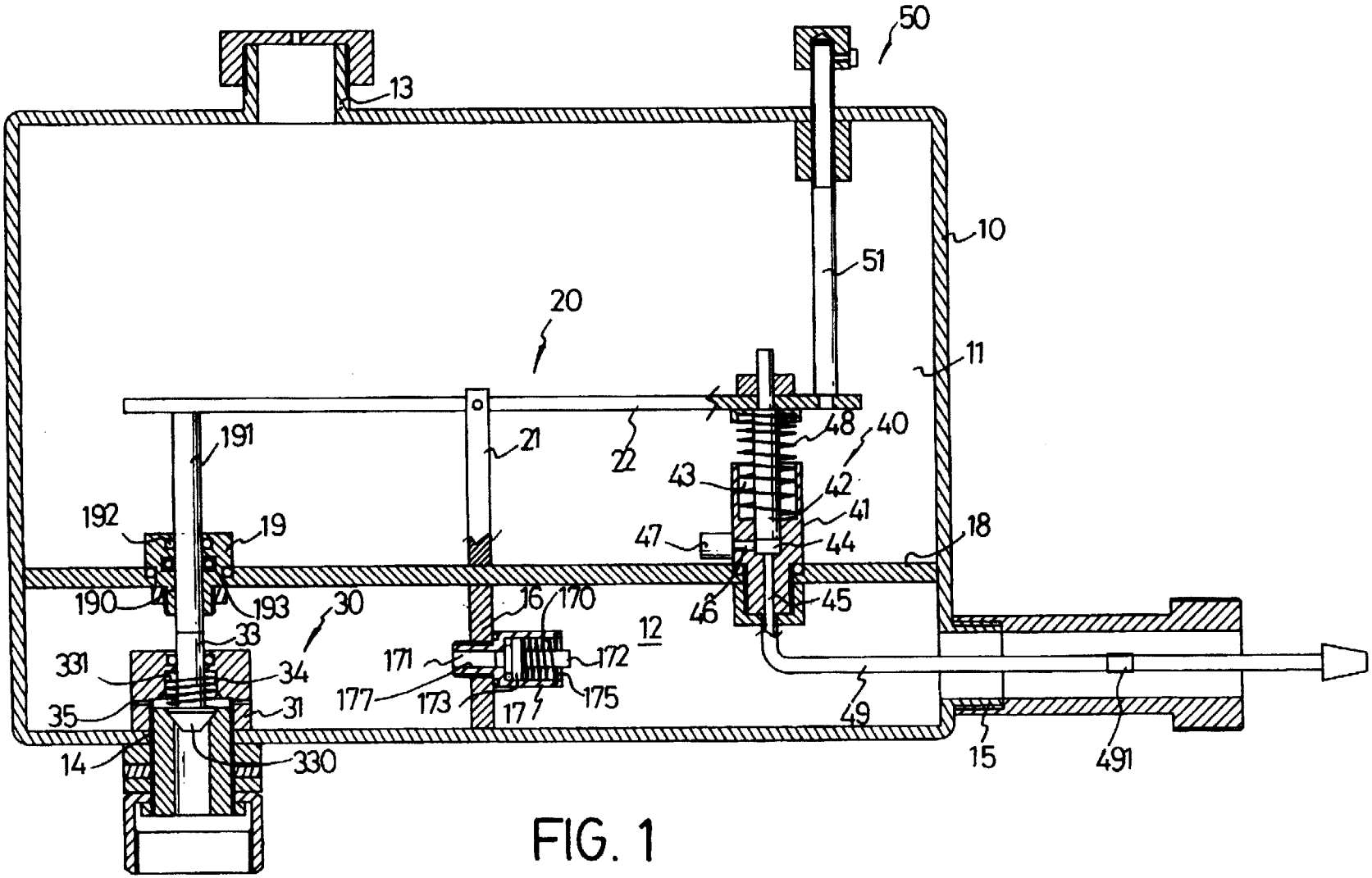
FIG. 1 is a cross sectional view of a detergent controlling means for use in a toilet constructed in accordance with the present invention.

Referring to FIG. 1, a detergent controlling means constructed in accordance with in present invention is shown. The detergent controlling means of the invention comprises a container 10 having a partition 18 which divides the container 10 into an upper portion 11 and a lower portion 12, a leverage 20 having a bridge 22 and a fulcrum 21 centrally and pivotally connected to the bridge 20 and securely mounted on the partition 18, an inlet valve 30 having a first rod 191 with a distal tip abutting a first end (not numbered) of the bridge 22, a one way valve 17 securely mounted onto a board 16 which securely and sealingly divides the lower portion 12 into a first part and a second part, and a releasing valve 40 having a second rod 42 securely mounted at a second end (not numbered) of the bridge 22, such that a reciprocal movement of the first rod 191 of the inlet valve 30 will drive the second rod 42 of the releasing valve 40 to move reciprocally. Additionally, the detergent controlling means of the invention further has an adjusting apparatus 50 having a fifth rod 51 threadingly extending through the container 10 and detachably connected with the second end of the bridge 22. A first entrance 13 communicating with the upper portion 11 is defined in the upper portion 11 of the container 10 for allowing detergent (not shown) to be poured into the upper portion 11. A second entrance 14 and a first exit 15 for clean water to respectively enter and exit the container 10 communicate with the lower portion 12 and are respectively defined in the first part and a second part of the lower portion 12. From the previous description, it is noted that the inlet valve 30 is mounted in the first part of the lower portion 12 and the one-way valve 17 is mounted through the board 16 to prevent the clean water in the second part from flowing back to the first part.

It is noted that a first seat 19 having a central hole 190 for reciprocally receiving the first rod 191 of the inlet valve 30 therethrough is mounted on the partition 18. At least two ring grooves (not shown or numbered) are defined in an outer periphery of the first rod 191, so that a first sealing 192 and a second sealing 193 are able to be received therein for tightly sealing an aperture (not shown) for receiving the first rod 191 therethrough and preventing the detergent received within the upper portion 11 from leaking to the lower portion 12.

Figure 2:
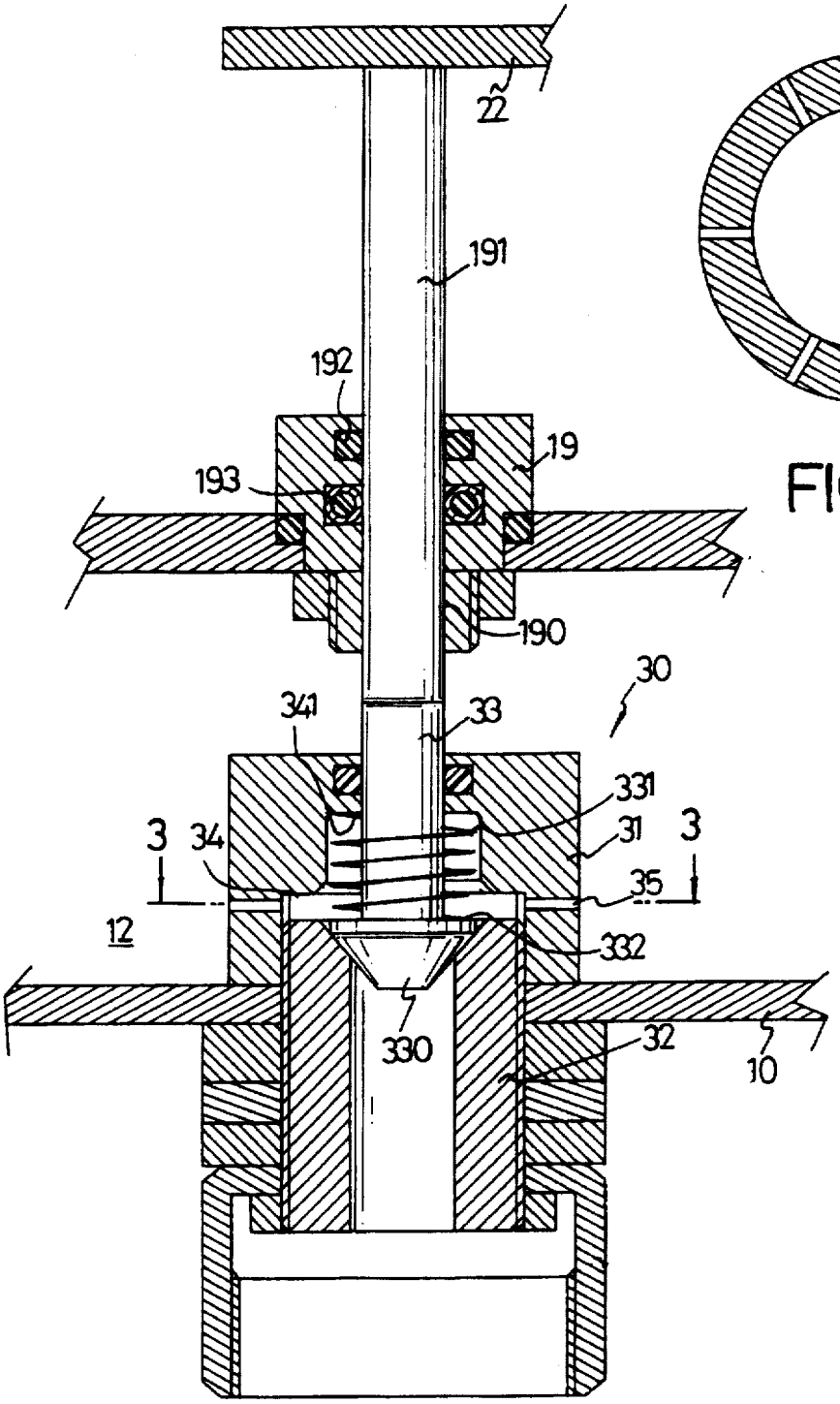
FIG. 2 a sectional view of an inlet valve of the means of the invention.

Referring to FIGS. 1 and 2, the inlet valve 30 is mounted above the second entrance 14 and is provided with a second seat 31 which is configured to have a channel (not shown or numbered) for receiving a fourth rod 33 therethrough, a chamber 34 communicating with the second entrance 14 and a plurality of through holes 35 defined on an outer periphery thereof (as seen from FIG. 3) and communicating with a first part of the lower portion 12. A first end of the fourth rod 33 abuts a first end of the first rod 191, and a second end of the fourth rod 33 is securely provided with a cone-shaped plug 330. A first coil spring 331 is received between a first end 341 of the chamber 34 and a first end 332 of the cone-shaped plug 330. A water hose 32 is threadingly connected with the second entrance 14 and communicates therewith, therefore, when the water hose 32 begins to supply fresh water, the fourth rod 33 will be pushed axially upward and the fresh water from the water hose 32 will flow into the first part of the lower portion 12 from the through holes 35 of the second seat 31. The first coil spring 331 securely received within the chamber 34 and between the first end 341 of the chamber 34 and the first end 332 of the plug 330 will then be compressed and will remain in a compressed state due to the upward movement of the fourth rod 33 and a pressure from the fresh water. Consequently, when the pressure difference between the first part and the second part no longer exists, the first end 332 of the cone-shaped plug 330 will then be pushed axially downward by the first coil spring 331 to block the through holes 35 to stop water from continuing flow through the through holes 35 and tightly seal an opening of the chamber 34.

Figure 3:
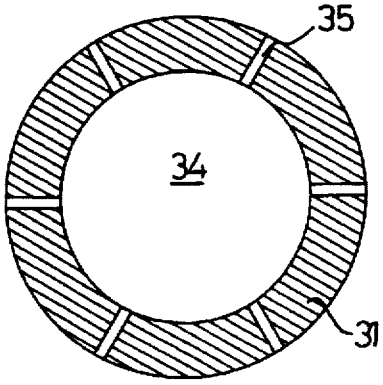
FIG. 3 is a top cross sectional view of a 3—3 line of the inlet valve shown in FIG. 2.
Figure 4:
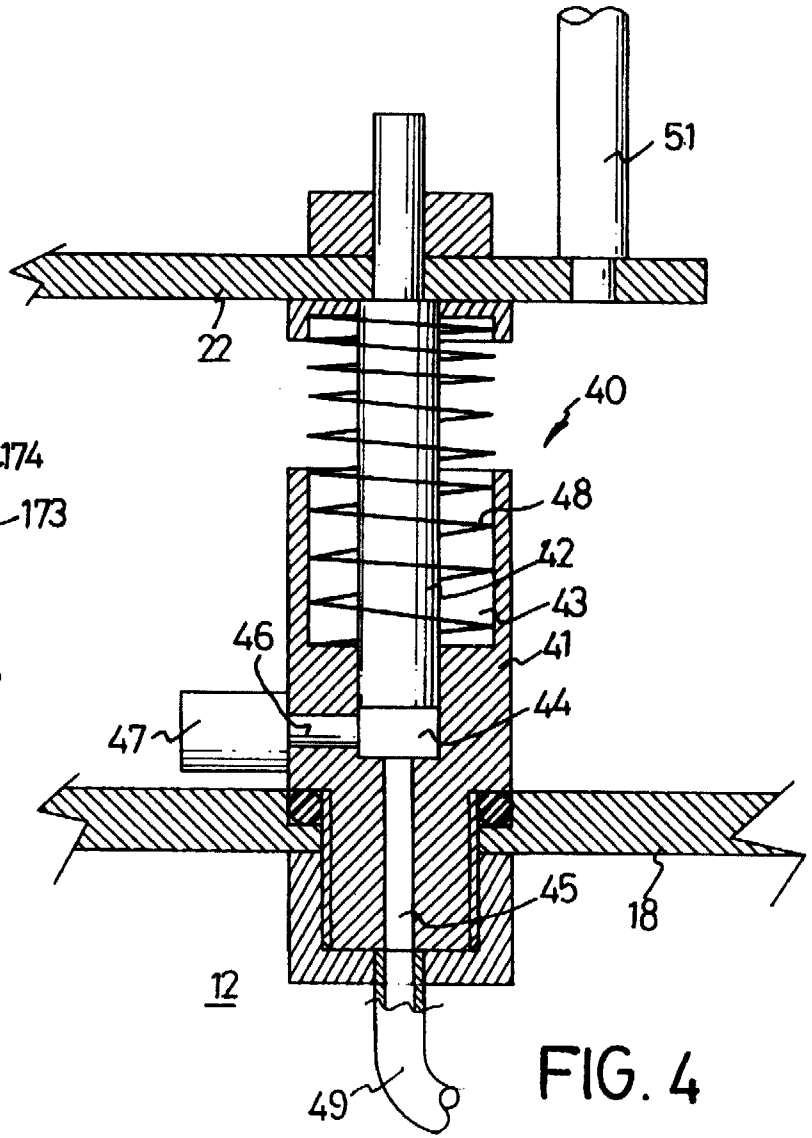
FIG. 4 is a cross sectional view of a releasing valve of the invention.

From the description of FIG. 3, it is to be understood that while the water pressure keeps applying onto the cone-shaped plug 330, the first end of the bridge 22 of the leverage 20 will be lifted upward by the axially upward movement of the first rod 191 and the fourth rod 33, and because of the pivotal connection between the fulcrum 21 and the bridge 22, the second end of the bridge 22 will then be pressed downward. Referring to FIG. 4, the releasing valve 40 is provided with the second rod 42 securely and sealingly mounted through the bridge 22, a second coil spring 48 mounted around the second rod 42, a barrel 41 having a first space 43 defined therein for receiving the second rod 42 therethrough and the second coil spring 48 therein, a second space 44 communicating with the first space 43, a third entrance 46 communicating with the upper portion 11 and a second exit 45 communicating with the lower portion 12. A first end of the second coil spring 48 abuts a lower face of the bridge 22 and a second end of the second coil spring 48 is securely received within the first space 43 of the barrel 41. A first valve 47 may be mounted at the third entrance 46 to direct the flow of detergent in the upper portion in only one direction. An extension tube 49 may also be provided at the second exit 45 to direct the detergent to flow to a water tank (not shown) and prevent pre-mixing of the detergent and the fresh water in the second part of the lower portion 12.

Since the second rod 42 of the releasing valve 40 is securely fixed through the bridge 22, the axially upward movement of the first rod 191 will result in that the second end of the bridge 22 to be pressed axially downward, which will consequently initiate the second rod 42 to move axially downward. Due to the regulation of the first valve 47 to the detergent stored in the upper portion 11, the detergent is not able to continue to flow into the second space 44 of the barrel 41 from the third entrance 46, thus the downward movement of the second rod 42 will urge the detergent stored in the second space 44 and the detergent being pressed out will flow to the water tank through the second exit 45 and the extension tube 49.

Figure 6:
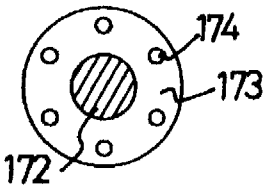
FIG. 6 is a cross sectional view of a line 6—6 of a plug shown in FIG. 5.
Figure 5:
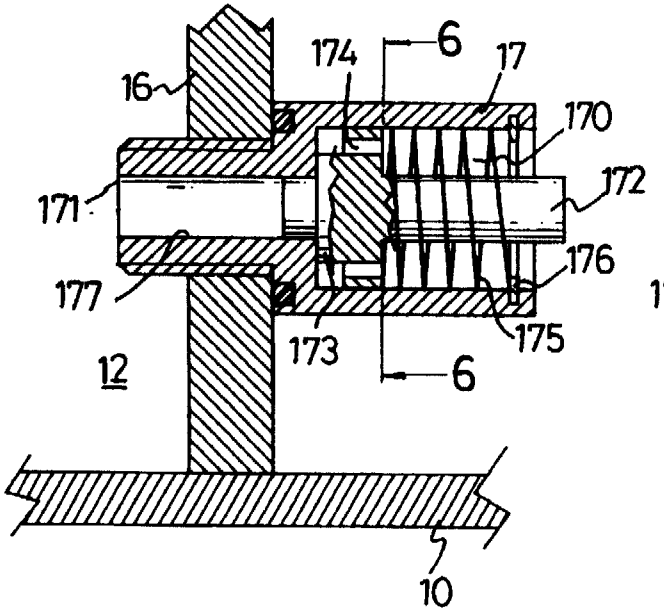
FIG. 5 is a cross sectional view of a one-way valve of the invention.

Referring to FIG. 5, the one-way valve 17 is securely mounted on a board 16 which separates the lower portion 12 into a first part and a second part (not numbered). The one-way valve 17 is provided with a channel 170 defined therein for reciprocally receiving a third rod 172 therein, a fourth entrance 171 defined at a first end of the channel 170 and communicating with the channel 170, a plug 173 securely received within the channel 170 and having the third rod 172 securely received therein and a plurality of holes 174 (as seen in FIG. 6) defined near an outer periphery thereof and communicating with the channel 170, a third coil spring 175 mounted around the third rod 172 and a first end of which extends between a first face of the plug 173 and a stop 176 provided at an end opposite to the fourth entrance 171. The channel 170 further has a passage 177 communicating with the channel 170 and configured to have a dimension slightly greater than that of the third rod 172, so that when the third rod 170 reciprocally moves into the passage 177, the third rod 172 mates with the passage 177 and thus seal the passage 177. By the configuration as described above of the one-way valve 17, fresh water can only flow from the first part to the second part of the lower portion 12 when the water pressures of both parts are not balanced.

Figure 7:
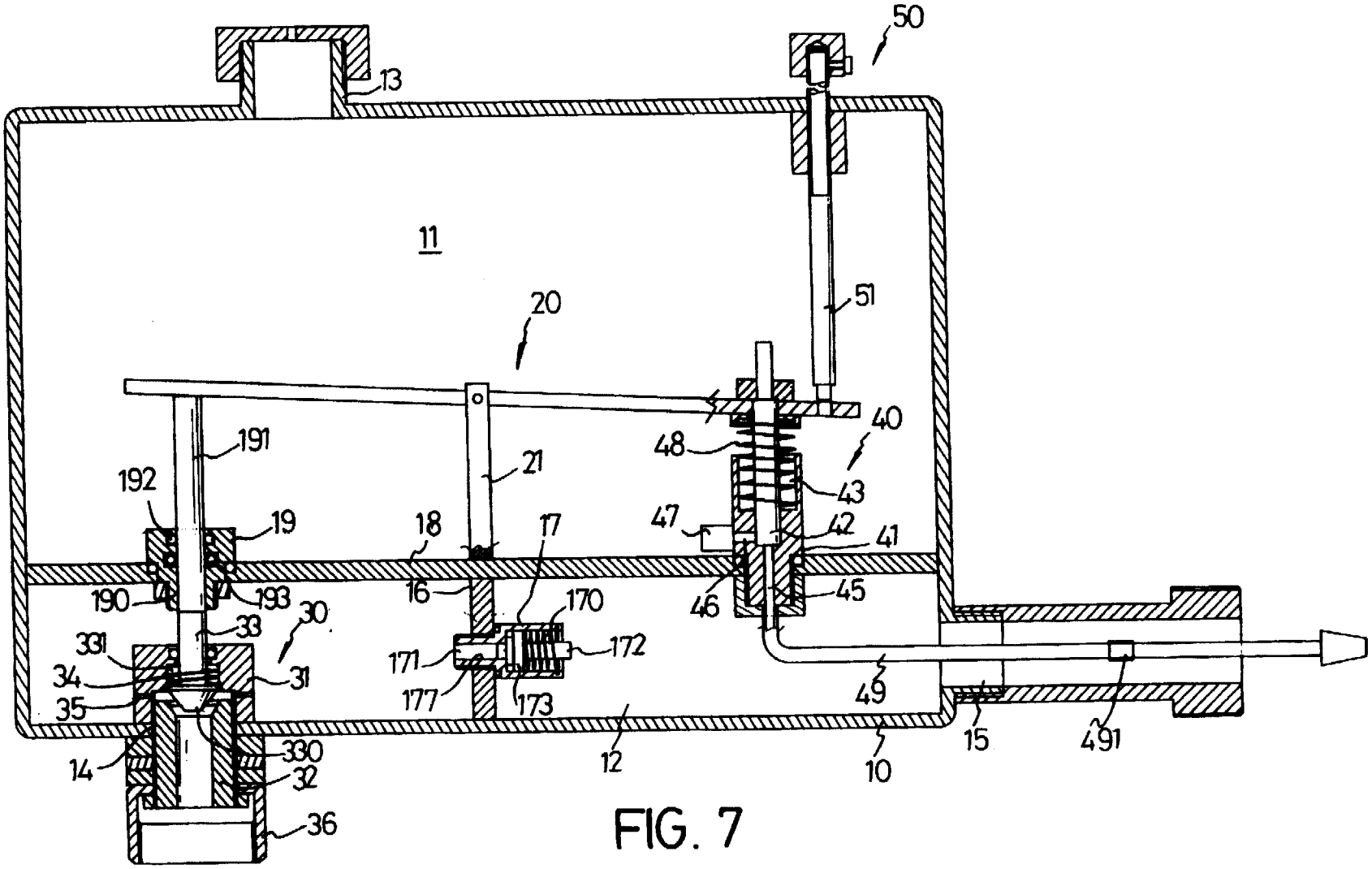
FIG. 7 is a schematic view showing the operation of the detergent controlling means of the invention.

Referring to FIG. 7 and taking FIG. 1 for reference, when water pressures of both parts of the lower portion 12 are balanced, none of the first rod 191, the second rod 42 and the third rod 172 will move. Yet, when a user flushes the toilet, the water mixed with the detergent forced out of the second space 44 by the second rod 42 of the releasing valve 40 will flow into the water tank to refill the water tank, thus the water pressure within the first part of the lower portion 12 will be greater than that of the second part, which will force the third rod 172 to move axially to the end opposite to the fourth entrance 171 of the one-way valve 17, thereby allowing water to flow from the first part to the second part of the lower portion 12 to recharge a space which was originally filled with water. When the situation of unbalanced water pressure occures between the first part and the second part of the lower portion 12, the water pressure from the water hose 32 will force the fourth rod 33 and the first rod 191 to move axially upward and thus open the through holes 35 to allow water to flow therethrough and to the first part. While the water is flowing into the first part of the lower portion 12, the bridge 22 will be inclined toward the second end thereof. Therefore, the inclination of the second end of the bridge 22 will force the second rod 42 to move axially downward and thus force the detergent stored within the second space 44 to flow out to the water tank through the extension tube 49. It is to be understood that when the water pressure between the first part and the second part of the lower portion 12 is balanced, the third rod 172 of the one-way valve 17 will be recoiled back to its original position due to the resilient force of the third coil spring 175 to stop water to continue to flow to the second part of the lower portion 12 and the second rod 42 of the releasing valve 40 and the first rod 191 of the inlet valve 30 will both be recoiled back to their original position due to the resilience force of both the second coil spring 48 and the first coil spring 331. Once the second rod 42 and the first rod 191 are back to their original positions, the second space 44 will again be exposed and the detergent stored within the upper portion 11 will automatically flow into the second pace 44 from the third entrance 46, and the cone-shaped plug 330 will again block the through holes 35 to stop water from continuing flowing therethrough.

The first entrance 13 defined in an outer periphery of the container 10 provides an access for pouring further detergent into the container 10 when the previous detergent is used up. Furthermore, the adjusting apparatus 50 having the fifth rod 51 threadingly connected with the outer periphery of the container 10 is to enable adjustment of the amount of the detergent ready to be stored within the second space 44, which uses a second end of the fourth rod 51 to abut the second end of the bridge 22 and by screwing in or screwing out the fourth rod 51 to adjust the inclination of the bridge 22 which determines the space of the second space 44.

Additionally, a uniflow valve 491 having a configuration similar to that of the one-way valve 17 may be provided in the extension tube 49 to prevent a reverse flow of the detergent from the water tank.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A detergent controlling means for use in a toilet comprising:

a container having a water hose securely connected thereto and a first entrance and an exit respectively mounted on an outer periphery thereof, a partition securely dividing said container into an upper portion and a lower portion and having a leverage securely mounted thereon, said leverage being provided with a fulcrum mounted onto the partition, a bridge centrally and pivotally connected with the fulcrum, a board sealingly and securely dividing said lower portion of said container into a first part and a second part, an inlet valve securely mounted in said first part and onto an outer periphery of said container and having a first rod slidably and sealingly received through said partition, and abutted to a first end of said bridge by a first end thereof, a fourth rod having a first end abutted to a second end of said first rod, and a second end securely mounted with a cone-shaped plug which is detachably connected with said water hose, a seat having a chamber defined therein and communicating with said water hose and a plurality of through holes defined near an outer periphery thereof and communicating with said chamber, and a first coil spring movably received within said chamber and confined between a first end of said chamber and a first end of said cone-shaped plug, a releasing valve securely mounted onto said partition and having a second rod securely and sealingly connected with a second end of said bridge, a barrel securely mounted onto said partition and having a first space and a second space defined therein; said second space is configured to have a third entrance communicating with said upper portion, a second exit and an extension tube communicating therewith, and a second coil spring mounted around said second rod and securely confined between said first space and an under face of said bridge, and a one-way valve securely mounted through said board and having a channel and a passage defined therein; said passage communicating with said channel, a fourth entrance defined at a first end of said passage and communicating with said first part of said lower portion, a stop securely mounted at a second end of said channel, a third rod reciprocally received within said channel, a plug securely mounted onto a first end of said third rod and having a plurality of holes defined near an outer periphery thereof, and a third coil spring securely confined between a face of said plug and said stop.

2. The detergent controlling means as claimed in claim 1 further comprising a first seat having a first sealing and a second sealing securely received therein, said first sealing and said second sealing being fixedly mounted around said first rod to tightly seal said first rod and said partition.

3. The controlling means as claimed in claim 1 further comprising an adjusting apparatus securely connected on an outer periphery of said container and having a fifth rod threadingly connected therewith, a first end of said fifth rod abutting said second end of said bridge of said leverage.

* * * * *